United States Patent [19]

Seitz

[11] Patent Number: 4,469,263

[45] Date of Patent: Sep. 4, 1984

[54] PAPER FEED TRACTOR WITH COMPENSATING DRIVE PULLEY

[75] Inventor: Alan F. Seitz, New Hartford, Conn.

[73] Assignee: Data Motion, Inc., Torrington, Conn.

[21] Appl. No.: 407,105

[22] Filed: Aug. 11, 1982

[51] Int. Cl.[3] ..... B65H 17/40; G03B 1/30

[52] U.S. Cl. ..... 226/74; 226/75

[58] Field of Search ..... 226/74, 75, 76, 77, 226/78, 79, 80, 81, 82, 83, 84, 85, 86; 242/71.8; 464/158, 87, 89, 180, 181, 86

[56] References Cited

U.S. PATENT DOCUMENTS

| | | | |
|---|---|---|---|
| 2,833,611 | 5/1958 | Alden | 464/87 X |
| 2,919,916 | 9/1956 | Davidson et al. | 226/81 |
| 2,956,187 | 10/1960 | Wood | 464/89 X |
| 3,015,425 | 6/1959 | Wicklund | 226/74 |
| 3,410,111 | 11/1968 | Ireland | 464/158 |
| 3,688,959 | 2/1976 | Staneck et al. | 226/75 |
| 3,750,919 | 8/1973 | Hoffman | 226/9 |
| 3,859,821 | 1/1975 | Wallace | 464/89 |
| 3,930,601 | 1/1976 | Masuda | 226/74 |
| 3,938,721 | 2/1976 | Staneck et al. | 226/75 |
| 3,941,288 | 3/1976 | Wanat | 226/74 |
| 4,129,239 | 12/1978 | Hubbard | 226/75 |
| 4,130,230 | 12/1978 | Seitz | 226/75 |
| 4,194,660 | 3/1980 | Seitz | 226/74 |
| 4,226,353 | 10/1980 | Blaskovic et al. | 226/74 |
| 4,227,821 | 10/1980 | Plaza et al. | 226/76 X |
| 4,239,405 | 12/1980 | Van Horne et al. | 400/616.1 |
| 4,400,105 | 8/1983 | Yeager et al. | 226/74 X |

*Primary Examiner*—Stuart S. Levy
*Assistant Examiner*—Scott J. Haugland

[57] ABSTRACT

A tractor for a web feeding assembly has a chassis providing a pair of apertures extending therethrough and a belt extending thereabout. A drive pulley mounted in one of the chassis apertures is engaged with the driven surface of the belt and has an aperture therethrough receiving the drive shaft. Resiliently deflectable means on the pulley defines at least a portion of the shaft receiving aperture and resiliently bears upon the drive shaft over a portion of its length. The deflectable means provides a passage portion of reduced cross section to engage the surface of the shaft. As a result, irregularities in the drive shaft, and variations in axial spacing of the shafts occuring during operation, may be accommodated by deflection of the deflectable means.

21 Claims, 18 Drawing Figures

PAPER FEED TRACTOR WITH COMPENSATING DRIVE PULLEY

BACKGROUND OF THE INVENTION

The present invention relates to drive tractors which are widely used in printers and other devices for handling webs such as continuous perforated paper, individual sheet paper, tape and the like, of paper, foil, laminates and other sheet-like material, all collectively referred to hereinafter as "web material".

Generally such devices employ a belt which will engage the web material either by pins or projections on the upper surface of the belt extending into perforations in the web material or by friction or "clamping" of the web material between the upper surface of the belt and a cover or guide thereabove. Such devices are in widespread use for the applications indicated above and are particularly burgeoning in usage for paper handling in printers for computers, word processing and duplicating apparatus.

Among the problems which have been encountered in the use of such tractors are aberrations in cross section in the drive shaft upon which the tractors are mounted, bowing or other deflection of the shafts in the distance between the pair of tractors mounted thereon and cooperating to drive the web material, and deflection of the shafts during operation. Tolerances in the shaft receiving apertures of the tractors, or in the clamping means, or both, have been proposed to accommodate the shaft irregularities discussed above. Hubbard U.S. Pat. No. 4,129,239 granted Dec. 12, 1978 discloses a tractor in which the clamping mechanism for the support shaft is a part of a pillow block on the chassis which may "float" in spacing relative to the drive shaft.

Particularly in high speed web handling devices, it is important that the spacing between the paper guiding surfaces and in fact between the shaft receiving portions be maintained substantially constant and that the tractor not move in the direction of web travel. This spacing and fixed positioning is critical to uniform advance of the web material, particularly when the drive tractor is bidirectional, i.e., movable backward and forward abruptly. Thus, there is need to accommodate aberrations in the shafts and variations in spacing between their axes while maintaning constant the distance between axes of the paper guide surfaces and the axes of the shaft receiving apertures and while avoiding any movement of the tractor relative to the printer or other device on which it is mounted. If not, undesirable variations in line spacing during printing of the web may occur.

It is an object of the present invention to provide a novel drive tractor for web material which readily accommodates aberrations in the drive shaft cross section and deviations in spacing between the axes of the drive and support shafts while maintaining essentially constant the axial spacing of the web guide surfaces and of the shaft receiving apertures in the tractor chassis.

It is also an object to provide such a drive tractor which may be fabricated readily and relatively economically and which will enjoy long life in operation.

Another object is to provide such a tractor which remains fixed on the printer or drive device upon which it is mounted so as to avoid variations in tension on the web material being driven thereby and line spacing in the web.

A further specific object is to provide such a tractor wherein the drive shaft may deflect within the drive pulley without effecting variation in spacing of the drive pulley relative to the other pulley or the support shaft receiving aperture.

SUMMARY OF THE INVENTION

It has now been found that the foregoing and related objects can be readily attained in a drive tractor which includes a chassis having a pair of spaced transversely extending apertures therein with at least one aperture being adjacent an end thereof. Extending about the chassis generally perpendicularly to the axes of the apertures is a flexible endless belt which defines a closed path of travel thereabout. The belt has an outer driving surface to engage the web material and an inner driven surface which is engaged with a drive pulley rotatably mounted in the chassis aperture adjacent the end thereof. The drive pulley has an aperture therethrough for receiving a drive shaft to effect its rotation and thereby the belt, and this pulley also has resiliently deflectable means defining at least a portion of the shaft receiving aperture and providing a cross section over at least a portion of the length thereof which is less than the cross section of the shaft to be received therein. As a result, the shaft may produce resilient deflection of the deflectable means to effect accommodation of irregularities in the shaft and in spacing between it and the support shaft.

The resiliently deflectable means may comprise a multiplicity of fingers defining an aperture of polygonal cross section with the fingers being fixed at one end and inclined therefrom to provide the reduced cross section adjacent their free ends.

In another embodiment, the resiliently deflectable means may comprise a resiliently compressible collar of synthetic resin having a body of resiliently compressible foam and a relatively wear resistant surface portion defining the shaft-receiving aperture. Desirably, the collar is an insert and the pulley has a passage therein seating the insert and means to engage the insert in fixed portion and prevent relative rotation therebetween.

In still another embodiment, the resiliently deflectable means may comprise a multiplicity of convexly arcuate ribs extending axially of the pulley. Preferably the convexly arcuate ribs are provided as a cage-like insert and the pulley has a passage therein seating the insert and means to engage the insert in fixed position therein and prevent relative rotation therebetween.

The assembly will normally include means for clamping the chassis on a support shaft having its axis extending parallel to the axis of the aperture of the first mentioned pulley. Generally, the second aperture receives the support shaft, and the clamping means is mounted on the chassis adjacent thereto.

The tractor may include a convexly arcuate belt support surface formed on the chassis at its end spaced from the drive pulley, or an idler pulley provided thereon, to support and guide the belt. The center for the radius of this arcuate surface, or idler pulley, is fixed so that the spacing between the axis of the drive pulley and the center for the arcuate guide surface or pulley is fixed and predetermined.

Thus in the tractors of this invention, the spacing between the axes of the drive pulley and of the cooperating arcuate guide surface is fixed and predetermined and the axial spacing between the drive pulley aperture and the support shaft aperture is fixed and predetermined. However, irregularities in the drive shaft, variations in spacing between the shafts and deflection of the drive shaft is accommodated by deflection of the deflecting means.

DETAILED DESCRIPTION OF THE ILLUSTRATED EMBODIMENT

Figure 1:
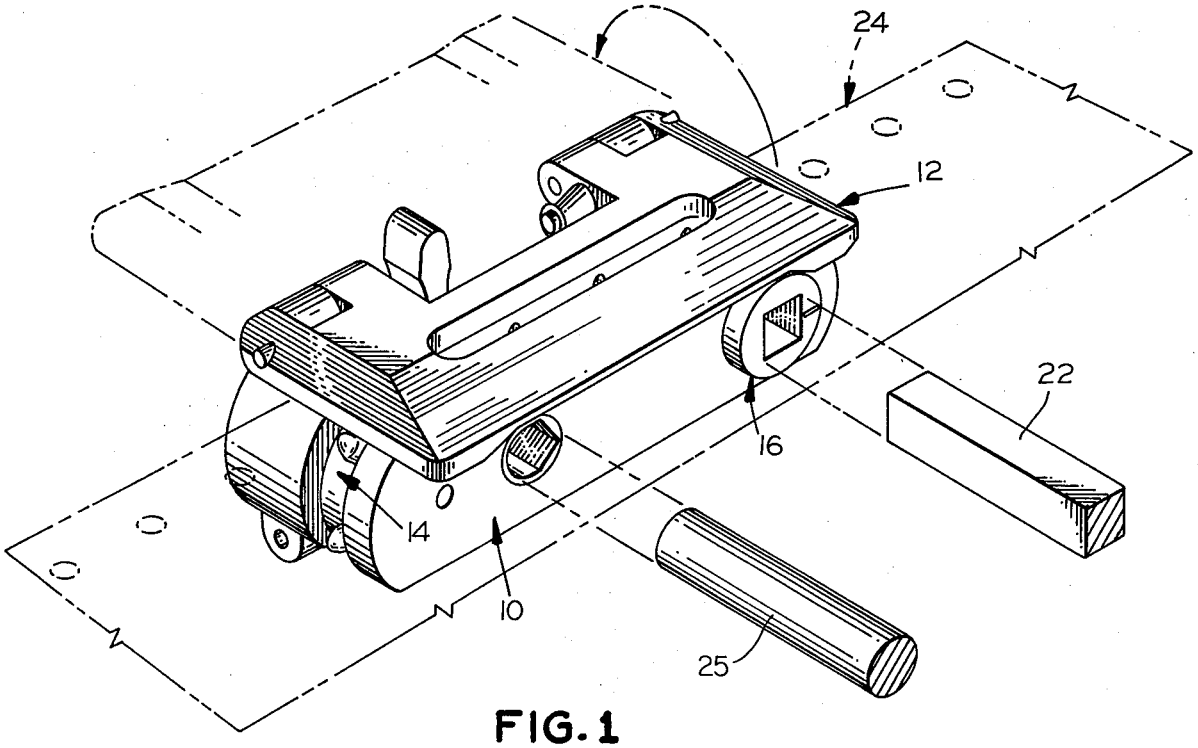
FIG. 1 is a perspective view of a tractor embodying the invention with the drive and support shafts fragmentarily illustrated in solid line, with the paper shown in phantom line, and with the cover shown in solid line in the closed, operative position and in phantom line in the open position.
Figure 2:
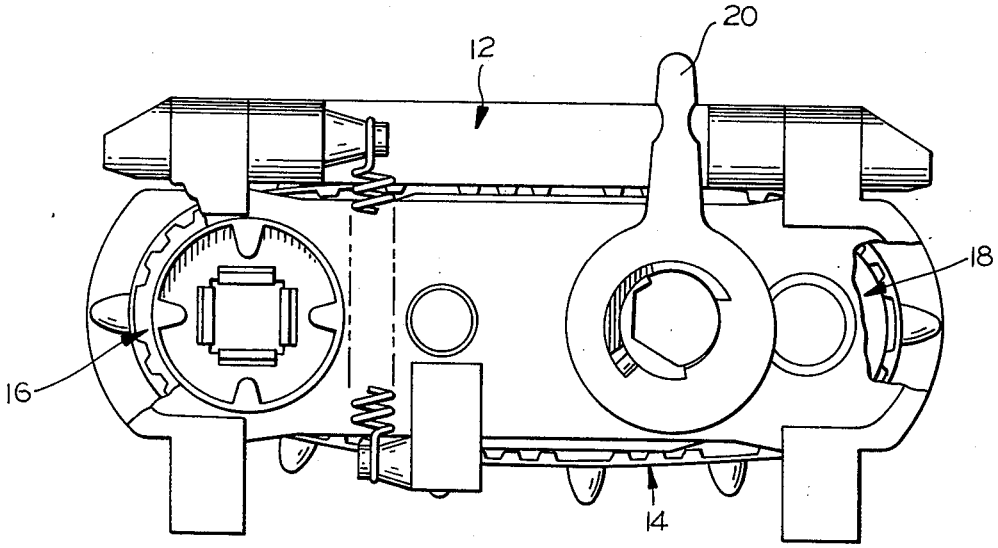
FIG. 2 is a side elevational view of the opposite side thereof with the portions of the chassis broken away for purposes of illustration.

Turning first to FIGS. 1 and 2 of the drawings, therein illustrated a directional tractor embodying the present invention and comprised of a chassis generally designated by the numeral 10, a cover generally designated by the numeral 12, a drive belt generally designated by the numeral 14, a drive pulley generally designated by the numeral 16, an arcuate guide surface generally designated by the numeral 18, and a cam lock subassembly generally designated by the numeral 20. The chassis 10 is adapted to mount a second cover 12 (not shown) to function as a bidirectional tractor.

Also shown partially in phantom line are fragmentary portions of the drive shaft 22 of rectangular cross section and the support shaft 25 of circular cross section upon which a pair of tractors are mounted (only one is shown). A web of perforated paper generally designated by the numeral 24 is shown disposed between the cover 12 and belt 14 to be driven along a path defined by the upper surface of the belt 14 when the drive shaft 22 is rotated by the printer or other powered device (not shown), as is conventional.

The general features of construction of the belt 14, covers 12, driver pulley or sprocket 16 and cam lock subassembly 20 are generally as described in U.S. Pat. Nos. 4,130,230, 4,194,660, and 4,315,585. The description thereof in each of these patents is incorporated herein by reference.

In the embodiment, the tractor has a single pulley 16 which is the drive pulley, and the arcuate guide surface 18 at the other end of the chassis 10 cooperates therewith to define the belt travel path. This axis or center for the radius of curvature for the surface 18 is indicated by the numeral 36 and the radius is equal to the radius of the root diameter of the teeth in the pulley 16.

As is more fully described and as is claimed in the concurrently filed applications of Alan F. Seitz, Ser. No. 416,682 filed Sept. 10, 1982 and Robert Wald, Ser. No. 416,859 filed Sept. 10, 1982, the illustrated tractor employs a chassis construction which includes belt tensioning means generally designated by the numeral 28 to apply tension to the belt in either direction of travel and hold the paper 24 against the inner surfaces of the covers 12. Because the features of that development are not essential to the present invention, reference may be made to the copending applications for more detailed description if so desired.

Briefly, however, as seen in FIGS. 3–6, the spacer portion of the chassis body 30 is molded with top and bottom recesses 32 intermediate the ends thereof and a pair of guide bosses 38 centered in each of the recesses 32 and defining a vertical channel therebetween. The spacer portion of the chassis body 30 also has surfaces 40 which slope inwardly towards the ends of the chassis body 30 on either side of the recesses 32. Seated in each of the recesses 32 and the channel between the bosses 38 is the spring biasing member generally designated by the numeral 42.

Figure 3:
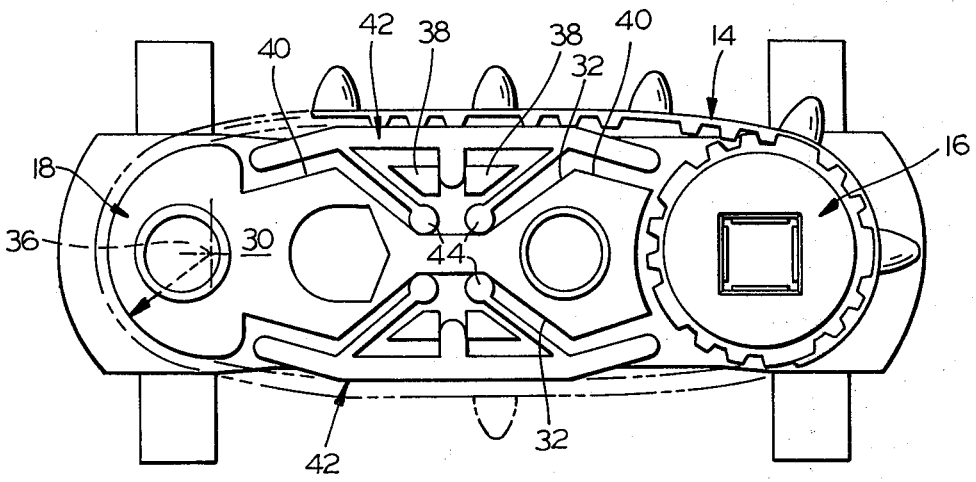
FIG. 3 is an elevational view of the side of the tractor seen in FIG. 1 with the side member and cover removed and showing the belt partially in phantom line.
Figure 4:
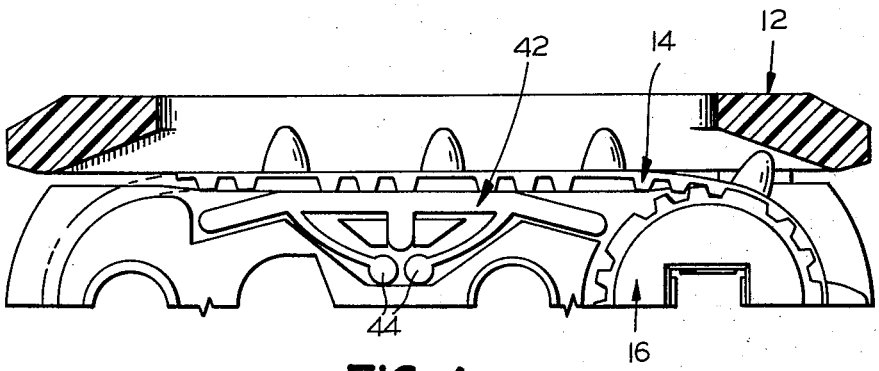
FIG. 4 is a fragmentary side elevational view similar to FIG. 3 with the cover fragmentarily illustrated in section.
Figure 5:
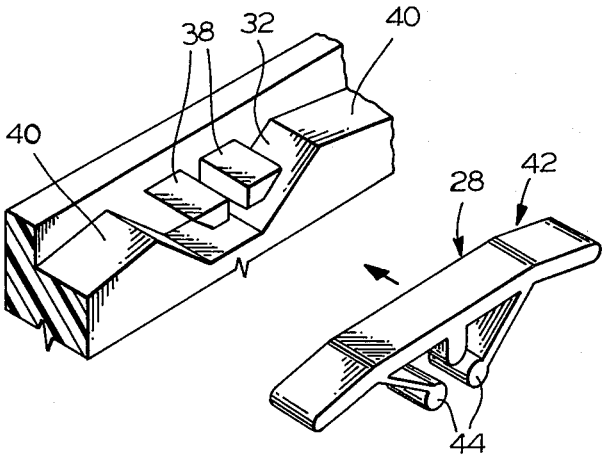
FIG. 5 is an exploded, fragmentary view of a portion of the frame and tensioning member.
Figure 6:
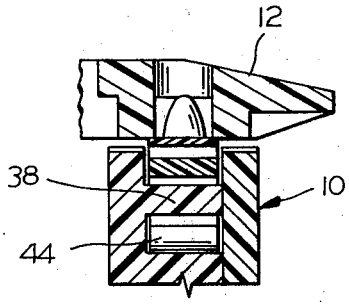
FIG. 6 is a fragmentary sectional view along the line 6—6 of FIG. 4.
Figure 7:
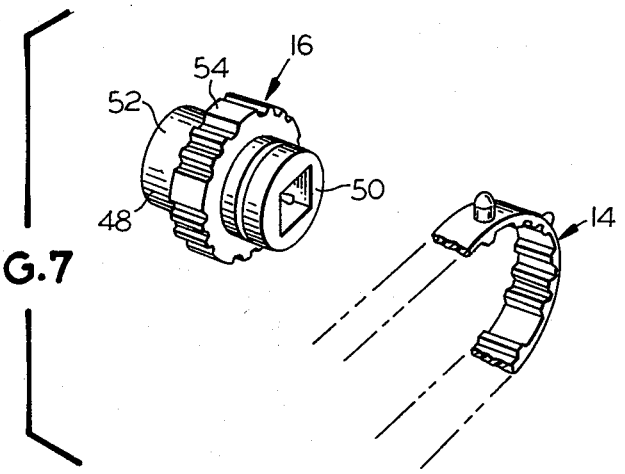
FIG. 7 is a perspective view of the drive pulley and a fragmentary portion of the belt.
Figure 8:
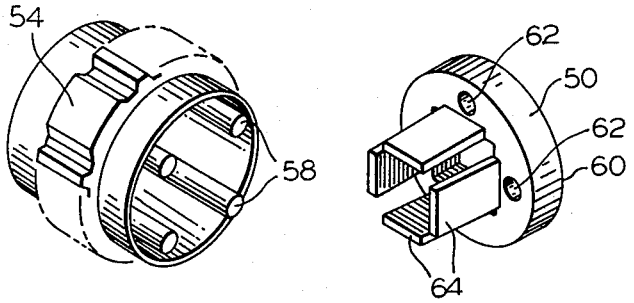
FIG. 8 is an exploded view of the drive pulley elements.
Figure 9:
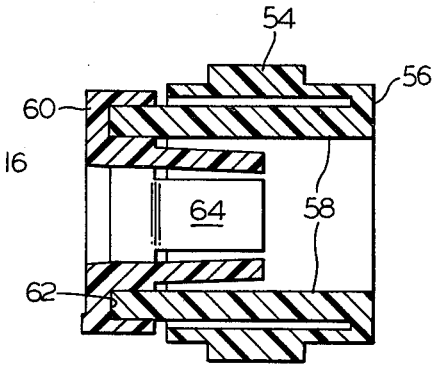
FIG. 9 is an axial sectional view of the drive pulley drawn to an enlarged scale.

As will be readily appreciated, the spring biasing member 42 is integrally molded from a synthetic resin providing resilient deformability for the spring leg portions 44 which are slidable in the sloping channels defined between the bosses 38 and the sloping walls of the recesses 32. A guide leg 46 on the member 42 slides in the vertical channel between the bosses 38. The upper surface of the spring biasing member 42 is normally urged by the spring leg portions 44 to a position above the plane defined by the bottom surface of the cover 12. However, as seen in FIGS. 3 and 4, when the cover 12 is closed and paper is disposed upon the belt 14 and below the cover 12, the belt 14 will be depressed from the position shown in FIG. 3 to that shown in FIG. 4, causing the leg portions 44 to deflect and producing a biasing pressure urging the member 42 and thereby the belt 14 against the inner or lower surface of the cover 12. This ensures that paper 24 being transported will travel in a path defined by the lower surface of the cover 12.

Turning first to the embodiment of drive pulley 16 shown in FIGS. 1–4 and 7–11, this pulley is of two piece construction and comprises the sprocket member 48 and the spring clamp member 50. The sprocket member 48 has a generally cylindrical wall 52 with the sprocket teeth 54 extending circumferentially thereabout, an end wall 56, and four cylindrical posts 58 on the end wall 56 spaced inwardly from the cylindrical wall 52 and extending axially to a point beyond the opposite end thereof. The spring clamp member 50 has an end wall 60 providing a square aperture therethrough and has four recesses 62 in its inner surface frictionally seating the posts 58. Inwardly extending fingers 64 project from the inner surface of the end wall 60 about the aperture and are inclined therefrom to define at their free end, a rectangular passage of lesser cross section than that of the aperture in the end wall 60, and also lesser than the cross section of the drive shaft 22.

Figure 10:
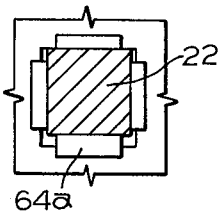
FIGS. 10 and 11 are fragmentary transverse sectional views of the drive pulley as assembled on the drive shaft diagrammatically showing the deflection of the fingers engaging the drive shaft.
Figure 11:
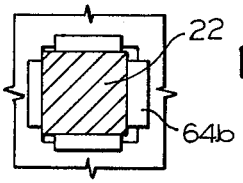

When the drive pulley 16 is seated on the drive shaft 22, resilient deflection to accommodate varying positions of drive shaft 22 is internally therewithin provided by two portions of the assembly. First of all, the spring fingers 64 are deflected upon insertion of the shaft 22 with the fingers 64 thereby being spring biased against the side surfaces of the shaft 22. Variations in the shaft positioning within the larger aperture defined by the end walls of the pulley 16 during operation of the bracket is accommodated by further flexing of the fingers 64. As seen in FIGS. 10 and 11, one finger 64*a*, or 64*b*, is shown more greatly deflected to illustrate the manner in which the fingers 64 accommodate the shaft position variation.

In addition, the entire spring clamp member 50 which provides the shaft gripping portion of the drive pulley 16 may move to a limited extent by resilient deflection of the posts 58 upon which it is carried. However, the axis of rotation of the drive pulley 16 remains constant, and the axial spacing between the drive pulley 16 and the arcuate guide surface 18 thereby remains constant.

Figure 12:
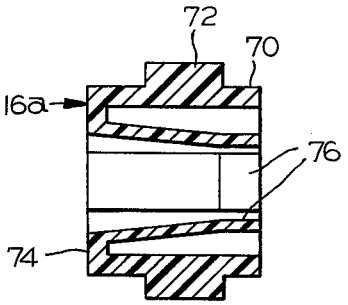
FIG. 12 is an axial sectional view of an alternate embodiment of the drive pulley of the present invention.

In the embodiment of FIG. 12, the drive pulley 16*a* is of one piece construction and has a cylindrical wall 70 with sprocket teeth 72 extending circumferentially thereabout, an end wall 74 providing a rectangular aperture, and four resiliently deflectable fingers 76 extending inwardly therefrom and having first portions inclined inwardly to define a rectangular passage between the axially extending end portions of reduced cross section relative to the aperture in the end wall 74. In this embodiment the fingers 76 terminate in a common plane with the opposite end of the cylindrical wall 70. As will be appreciated, the fingers 76 will grip the drive shaft 22 and accommodate variations in spacing and eccentricity of operation thereof in the same fashion as the fingers 64 of the previous embodiment.

Figure 13:
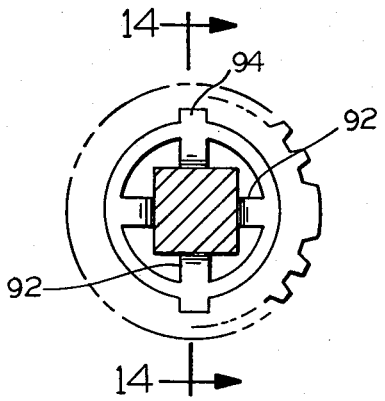
FIG. 13 is a fragmentary side elevational view of a tractor employing another embodiment of drive pulley of the present invention.
Figure 14:
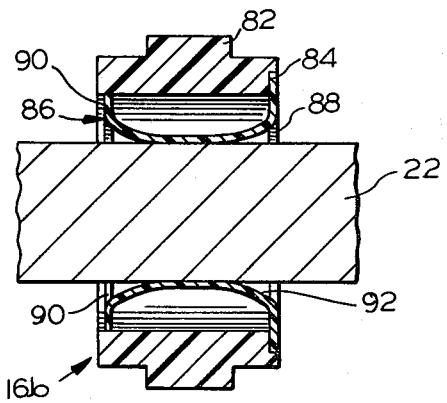
FIG. 14 is a fragmentary sectional view along the line 14—14 of FIG. 13.

In the embodiment of FIGS. 13 and 14, the drive pulley 16*b* has a cylindrical wall 80 with sprocket teeth 82 formed circumferentially thereabout and a diametrically spaced pair of grooves 84 in the inner surface at one end of the wall 80. Seated in the circular bore defined by the wall 80 is an integrally molded spring clamp member generally designated by the numeral 86 having generally annular end walls 88, 90 and four convexly arcuate ribs 92 extending generally axially therebetween. The end wall 88 has diametrically opposed, outwardly extending projections 94 which seat in the grooves 84 formed in the end of the cylindrical wall 80. The projections 94 may be bonded in the grooves 84 to lock the two elements in assembly. As will be appreciated, the ribs 92 in this embodiment will function similarly to the deflectable fingers in the previously described embodiments and are deflected by the drive shaft 22 when initially assembled and thereafter accommodate deviations and eccentricities.

Figure 15:
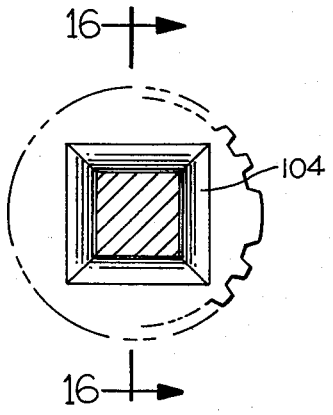
FIG. 15 is a side elevational view of still another drive pulley embodying the present invention.
Figure 16:
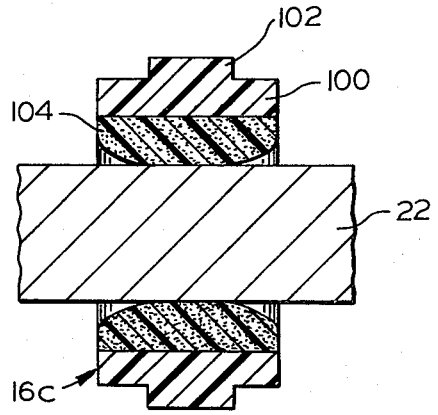
FIG. 16 is a fragmentary sectional view thereof along the line 16—16 of FIG. 15.

Turning now to the embodiment of FIGS. 15 and 16, the drive pulley 16*c* has a body 100 with sprocket teeth 102 therebout and a rectangular bore extending therethrough. Seated in the bore is a resiliently compressible synthetic resin insert or collar 104 of rectangular external configuration and providing a passage therethrough of rectangular cross section. The walls of the collar 104 defining the rectangular passage are convexly arcuate to provide a reduced cross section portion where the material in the axial direction of the collar is resiliently compressed upon insertion of the drive shaft 22. Thereafter, the material of the collar 104 will be resiliently compressed to accommodate variations and eccentricities in the operation of the shaft 22.

Figure 18:
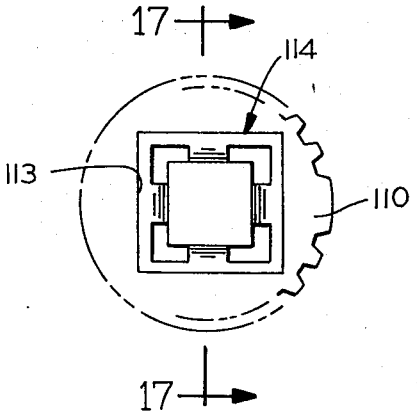
FIG. 18 is an end elevational view of the embodiment of FIG. 7.
Figure 17:
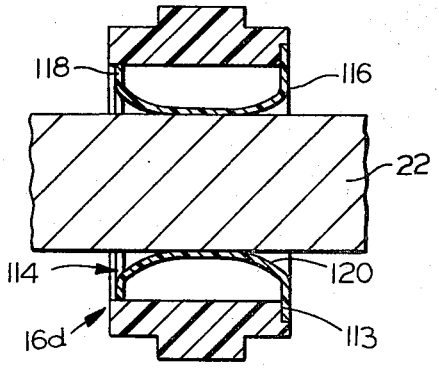
FIG. 17 is an axial sectional view of a still further embodiment of drive pulley.

Turning lastly to the drive pulley embodiment of FIGS. 17 and 18, the drive pulley 16*d* has a body 110 with sprocket teeth 112 extending circumferentially thereabout and a rectangular bore therethrough. A rectangular recess 113 is provided in one end of the body 110 about the bore. Seated in the bore is a resiliently deflectable cage member 114 having end walls 116, 118 of rectangular cross section, and convexly arcuate, axially extending ribs 120 extending therebetween. The end wall 116, which is of larger cross section than the bore in the body 110, seats in the recess 113 and is bonded therein by ultrasonic welding, adhesive or other suitable means. The end wall 118 is smaller in cross section than the bore of the body 110 and is slidably disposed therewithin at a point spaced from the end thereof. Upon deflection, the end wall 118 will slide within the bore as the ribs 120 are deflected by the drive shaft 22.

In each of the illustrated embodiments, it can be seen that the drive pulley has a passage therethrough which is of rectangular cross section to cooperate with the conventionally employed rectangular cross section for the drive shaft. In each embodiment, resiliently deflectable means on the drive pulley disposed in the shaft receiving passage reduces the cross section of the passage so that, when the tractor is assembled on the drive shaft, the resiliently deflectable means is deflected (or compressed in the instance of the one embodiment) to provide resilient bearing pressure on the sides of the drive shaft. If the center-to-center spacing of the drive and support shafts is not equal to the axial spacing of the drive pulley and arcuate guide surface in the tractor, this will result in more deflection in one area than another. However, there will be adequate clamping pressure about all of the drive shaft provided by the resilience of the deflectable means.

Moreover, the polygonal nature of the passage defined by the deflectable means will ensure that the corners of the shaft will not rotate relative thereto. In operation of the tractor, most eccentricities in rotation of the drive shaft will be readily accommodated by the resilient deflection. However, at all times the axial spacing of the drive pulley and arcuate guide surface, and the axial spacing of the apertures for the shafts, remain constant.

As will be appreciated, the pulleys of the tractors of the present invention may be of the type having teeth formed therein to engage cooperating teeth on the driven surface of the belt, such as illustrated in the aforementioned Seitz Patents, or they may employ a friction surface to engage a frictional driven surface on the belt, or they may employ any other suitable means for effecting driving engagement therebetween.

Moreover, as is conventional for larger tractors, an idler pulley may be employed at the other end of the chassis to provide the belt support surface rather than the arcuate shoe surface of the illustrated embodiment. Such idler pulley assemblies are shown in the aforementioned Seitz Patents. Moreover, this type of assembly may have a third aperture for the idler pulley. However, the support shaft receiving aperture may be an aperture or passage through the idler pulley with that pulley rotating about a fixed axis and the clamping means being supported on the chassis outwardly thereof and in a fixed position relative thereto.

Thus, it can be seen from the foregoing detailed specification and attached drawings that the drive tractor of the present invention readily accommodates abnormalities or inaccuracies in the drive shaft, minor variations in spacing between the two shafts and irregularities or eccentricities on rotation of the drive shaft. The tractors may be readily fabricated from relatively economical parts and are adapted to long lived, trouble-free operation.

Having thus described the invention, what is claimed is:

1. In a drive tractor for web material adapted to be mounted on a printer or the like having spaced parallel extending drive and support shafts, the combination comprising:

A. a chassis having a pair of spaced transversely extending apertures therein, at least one of said apertures being adjacent an end of said chassis;

B. a flexible endless belt extending about said chassis generally perpendicularly to the axes of said apertures, said belt defining a closed path of travel thereabout and having an outer driving surface adapted to engage the associated web material and an inner driven surface;

C. a pulley rotatably mounted in said at least one said chassis aperture and in engagement with said driven surface of said belt, said pulley having an aperture therethrough for receiving the associated drive shaft to effect rotation of said pulley and thereby said belt, said pulley having resiliently deflectable means for accommodating irregularities in the associated drive shaft and variations in spacing between the axes of the associated shafts during operation of the tractor, said deflectable means extending axially within said pulley and defining at least a portion of said shaft receiving aperture and providing a cross section therefor over at least a portion of the axial length thereof less than the cross section of the shaft to be received therein whereby the associated drive shaft may produce resilient deflection of said resiliently deflectable means.

2. The tractor in accordance with claim 1 wherein said resiliently deflectable means comprises a multiplicity of fingers defining an aperture of polygonal cross section, said fingers being fixed at one end and inclined therefrom to provide said reduced cross section adjacent their free ends.

3. The tractor in accordance with claim 1 wherein said resiliently deflectable means comprises a multiplicity of convexly arcuate ribs extending axially of said pulley.

4. The tractor in accordance with claim 3 wherein said convexly arcuate ribs are provided as a cage-like insert and said pulley has a passage therein seating said insert, said pulley having means to engage said insert in fixed position therein and prevent relative rotation therebetween.

5. The tractor in accordance with claim 1 wherein said resiliently deflectable means comprises a resiliently compressible collar of synthetic resin.

6. The tractor in accordance with claim 5 wherein said collar has a body of resiliently compressible foam and a relatively wear resistant surface portion defining said shaft-receiving aperture.

7. The tractor in accordance with claim 5 wherein said collar is an insert and wherein said pulley has a passage therein seating said insert, said pulley having means to engage said insert in fixed position and prevent relative rotation therebetween.

8. The tractor of claim 1 wherein there is included means for clamping said chassis on the associated support shaft having its axis extending parallel to the axis of the drive shaft and being disposed in said other aperture of said chassis.

9. The tractor of claim 8 wherein said clamping means is mounted on said chassis adjacent said other aperture.

10. The tractor of claim 9 wherein said tractor includes convexly arcuate belt support means adjacent the end of said chassis spaced from said drive pulley and wherein the spacing between the center for the radius of said belt support means and the center of said drive pulley is fixed and predetermined.

11. The tractor of claim 10 wherein the axial spacing between said drive pulley aperture and said other aperture is fixed and predetermined and wherein variations in spacing between the shafts and deflection of the shafts is accommodated by deflection of said deflecting means.

12. In a web feeding assembly, the combination comprising:

A. a web feeding drive apparatus having spaced, parallel extending drive and support shafts;

B. a pair of tractors each mounted on said pair of shafts in axially spaced relationship therealong, each of said tractors having:

(i) a chassis having a pair of spaced transversely extending apertures therein, at least one of said apertures being adjacent one end of said chassis said shaft extending through, said at least one aperture and said support shaft extending through the other of said apertures;

(ii) a flexible endless belt extending about said chassis generally perpendicularly to the axes of said apertures and shafts, said belt defining a closed path of travel thereabout and having an outer driving surface adapted to engage web material and an inner driven surface;

(iii) a pulley rotatably mounted in said at least one chassis aperture and in engagement with the driven surface of said belt, said pulley having an aperture therethrough receiving said drive shaft therein to effect rotation of said pulley and thereby said belt, said pulley having resiliently deflectable means for accommodating irregularities in said drive shaft and variations in spacing between the axes of said drive and support shafts during operation of each of said tractors, said deflectable means defining at least a portion of said shaft receiving aperture and resiliently bearing upon said drive shaft over a portion of its length, said deflectable means providing a portion of reduced cross section therefor over the area bearing upon said shaft, whereby said drive shaft may produce deflection of said deflectable means.

13. The web feeding assembly of claim 12 wherein said resiliently deflectable means comprises a multiplicity of fingers defining an aperture of polygonal cross section, said fingers being fixed at one end and inclined therefrom to provide said reduced cross section adjacent their free ends.

14. The web feeding assembly of claim 12 wherein said resiliently deflectable means comprises a multiplicity of convexly arcuate ribs extending axially of said pulley.

15. The web feeding assembly of claim 14 wherein said convexly arcuate ribs are provided as a cage-like insert and said pulley has a passage therein seating said insert, said pulley having means to engage said insert in fixed position therewithin and prevent relative rotation therebetween.

16. The web feeding assembly of claim 12 wherein each of said tractors additionally includes means releasably clamping said chassis on said support shaft.

17. The web feeding assembly of claim 16 wherein said clamping means is mounted on said chassis adjacent the other of said apertures in said chassis.

18. The web feeding assembly of claim 17 wherein the spacing between the axes of said other aperture and of said drive pulley is fixed and predetermined and wherein variations in spacing between said shafts and deflection of said shafts is accommodated by deflection of said deflectable means and of said posts.

19. The web feeding assembly of claim 12 wherein said resiliently deflectable means comprises a resiliently compressible collar of synthetic resin.

20. The web feeding assembly of claim 19 wherein said collar has a body of resiliently compressible foam and a relatively wear resistant surface portion defining said shaft-receiving aperture.

21. The web feeding assembly of claim 19 wherein said collar is an insert and wherein said pulley has a passage therein seating said insert, said pulley having means to engage said insert in fixed position and prevent relative rotation therebetween.

* * * * *